US009498044B2

(12) United States Patent
Chen

(10) Patent No.: US 9,498,044 B2
(45) Date of Patent: Nov. 22, 2016

(54) COSMETIC APPLICATOR

(71) Applicant: Capicolor International Cosmetics Ltd., Taichung (TW)

(72) Inventor: Ming-Hung Chen, Taichung (TW)

(73) Assignee: Capicolor International Cosmetics Ltd., Taichung (TW)

( * ) Notice: Subject to any disclaimer, the term of this patent is extended or adjusted under 35 U.S.C. 154(b) by 184 days.

(21) Appl. No.: 14/546,737

(22) Filed: Nov. 18, 2014

(65) Prior Publication Data

US 2016/0135566 A1 May 19, 2016

(51) Int. Cl.

| | |
|---|---|
| ***A45D 34/04*** | (2006.01) |
| ***B43K 1/00*** | (2006.01) |
| *B43K 5/18* | (2006.01) |
| *A45D 34/00* | (2006.01) |

(52) U.S. Cl.

CPC ..... *A45D 34/042* (2013.01); *A45D 2034/005* (2013.01); *B43K 1/003* (2013.01); *B43K 5/18* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,276,860 | B1 * | 8/2001 | Nakajima | B43K 8/08 401/199 |
| 6,474,893 | B1 * | 11/2002 | Osada | B43K 1/00 401/196 |
| 6,619,870 | B2 * | 9/2003 | Furukawa | B43K 5/18 401/198 |

* cited by examiner

*Primary Examiner* — David Walczak
(74) *Attorney, Agent, or Firm* — The Webb Law Firm

(57) ABSTRACT

A cosmetic applicator includes a casing, a cartridge disposed in the casing, a sleeve coupled to the casing, and a core. The cartridge includes a tube member formed with at least one protrusion, and a plug member having a shoulder section abutting against the tube member, a rear end section abutting airtightly against the protrusion, and a front end section. The sleeve has a rear end portion sleeved on the front end section and abutting against the shoulder section of the plug member, and at least one protrusion abutting airtightly against the front end section. The core has an absorbing segment extending through the sleeve and the plug member for absorbing liquid cosmetic, and a liquid output segment extending out of the sleeve.

9 Claims, 12 Drawing Sheets

COSMETIC APPLICATOR

FIELD OF THE INVENTION

The invention relates to a cosmetic product, more particularly to a cosmetic applicator for applying liquid cosmetic.

BACKGROUND OF THE INVENTION

Referring to FIG. 1, a conventional cosmetic applicator 10 (such as an eyeliner) includes a casing 11, an adjusting member 12, a cartridge 13, a core 14, a seat 15 and a brush 16. The cartridge 13 is connected to a rear end section of the adjusting member 12, and includes a tube member 131 containing liquid cosmetic, and a plug member 132 plugged into an open end of the tube member 131 and connected to the adjusting member 12. The adjusting member 12 is formed with an axial hole 121 for insertion of the core 14. The core 14 has a rear end extending through the plug member 132 for absorbing the liquid cosmetic in the tube member 131. A plurality of adjusting plates 122 are provided on an outer surface of the adjusting member 12, and spaces among the adjusting plates 122 are in spatial communication with the axial hole 121 such that the liquid cosmetic absorbed by the core 14 can spread to the adjusting plates 122 for storage and regulation. The seat 15 is sleeved onto a front end of the adjusting member 12 with at least one opening 151 formed in an outer side thereof. The outer side of the seat 15 and the adjusting member 12 cooperatively define a passage 152. Air flows into the passage 152 via the opening 151, and then flows through the core 14 and reaches the adjusting plates 122 of the adjusting member 12. The brush 16 is partially disposed in the seat 15 with a front end thereof protruding from the seat 15, and a rear end thereof connected to the core 14. The liquid cosmetic flows out of the brush 16 after being absorbed by the core 14.

Although the aforementioned conventional cosmetic applicator 10 has an automatic liquid cosmetic flowing effect, there is still room for improvement. Since the adjusting member 12 is only covered by the casing 11, and the tube member 131 is connected to the adjusting member 12 via the plug member 132, the liquid cosmetic accumulated among the adjusting plates 122 might leak through a gap between the adjusting member 12 and the casing 11. In addition, if the airtightness of the coupling between the tube member 131 and the plug member 132 is poor, the liquid cosmetic will leak through a gap between the tube member 131 and the plug member 132, and spread through an internal space among the casing 11, the adjusting member 12, and the cartridge 13, which causes waste of the liquid cosmetic.

SUMMARY OF THE INVENTION

Therefore, the object of the present invention is to provide a cosmetic applicator that can eliminate the aforesaid drawbacks of the prior art.

According to the present invention, there is provided a cosmetic applicator including a casing, a cartridge, a sleeve and a core. The cartridge is disposed in the casing and includes a tube member and a plug member. The tube member is adapted for containing liquid cosmetic, and has an open end portion, and at least one protrusion formed on an inner surface of the open end portion. The plug member has a shoulder section, front and rear end sections and a positioning hole. The shoulder section abuts against an end of the open end portion. The rear end section extends from the shoulder section into the tube member, and has an outer surface abutting airtightly against the at least one protrusion. The front end section is connected to the shoulder section and is opposite to the rear end section. The positioning hole extends through the rear end section, the shoulder section and the front end section.

The sleeve is fixedly coupled to a front end of the casing and has a rear end portion and at least one protrusion. The rear end portion is sleeved on the front end section of the plug member, and has a rear end abutting against the shoulder section of the plug member. The at least one protrusion is formed in an inner surface of the rear end portion and abuts airtightly against an outer surface of the front end section of the plug member.

The core has an absorbing segment that extends through the sleeve and the positioning hole of the plug member for absorbing the liquid cosmetic, and a liquid output segment that extends out of the sleeve.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
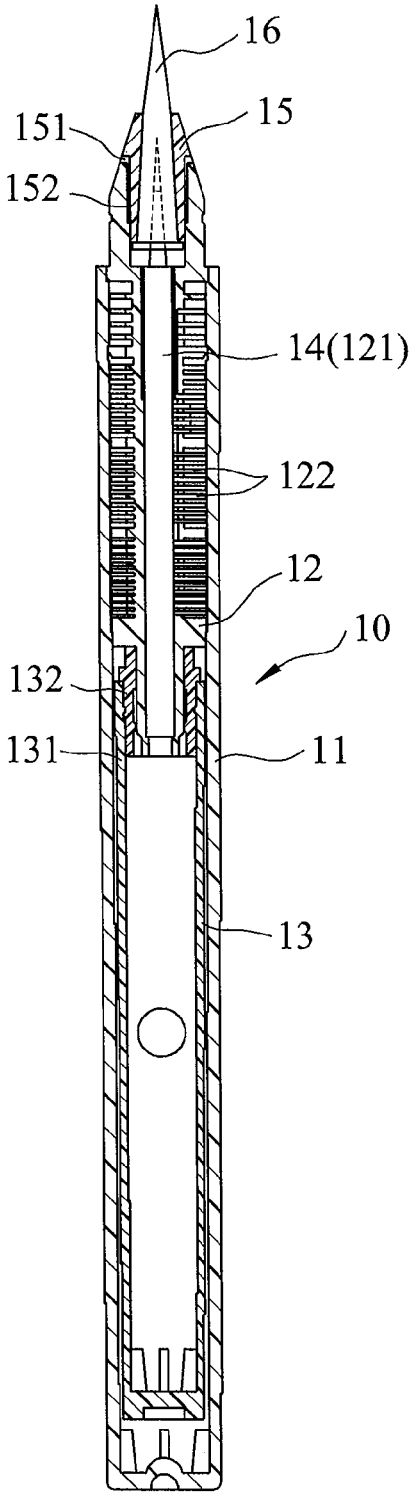
FIG.1 PRIOR ART
FIG. 1 is an assembled sectional view of a conventional cosmetic applicator.
Figure 2:
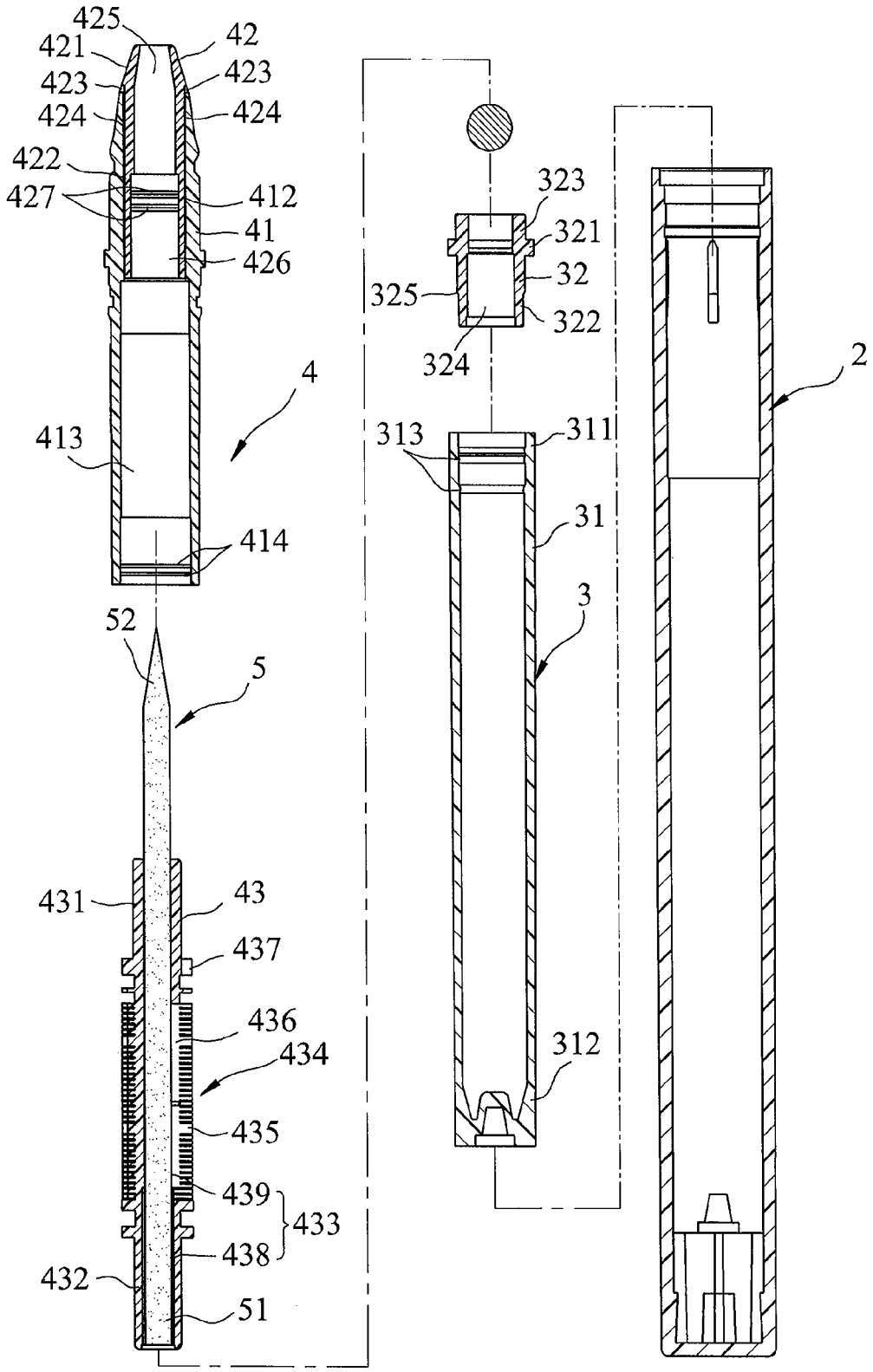
FIG. 2 is a partly-exploded sectional view of an embodiment of a cosmetic applicator according to the present invention, in which a cap is omitted.
Figure 3:
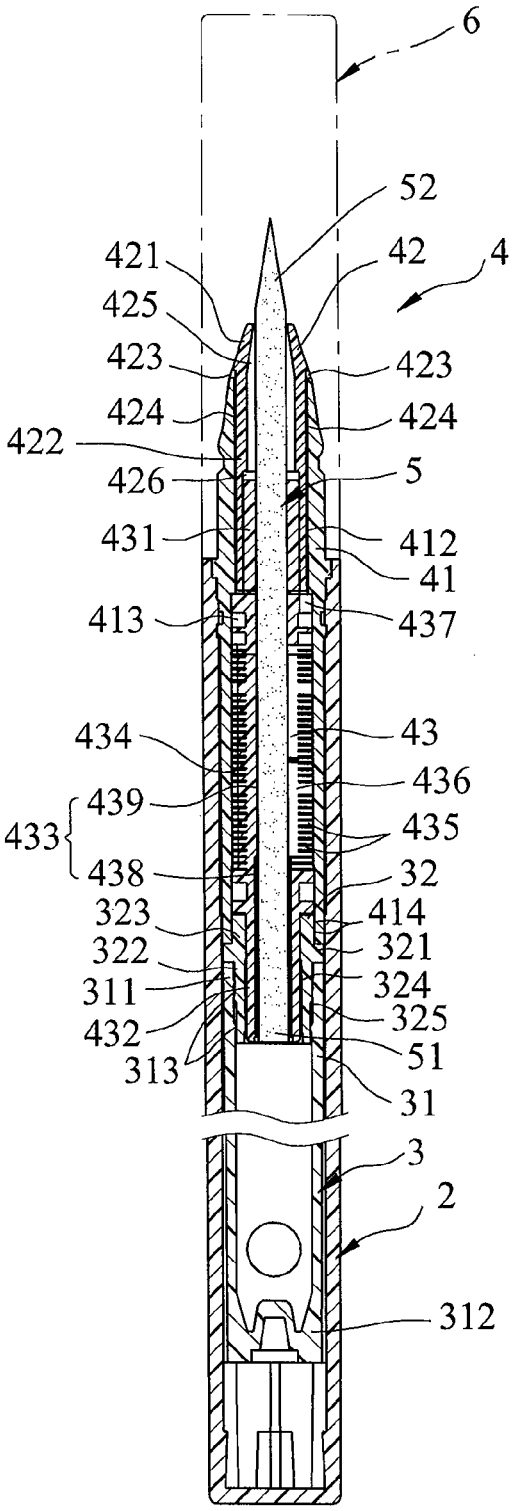
FIG. 3 is a fragmentary assembled sectional view of the embodiment.

Referring to FIGS. 2 and 3, an embodiment of a cosmetic applicator according to the present invention includes a casing 2, a cartridge 3, a sleeve unit 4, a core 5 and a cap 6.

Figure 4:
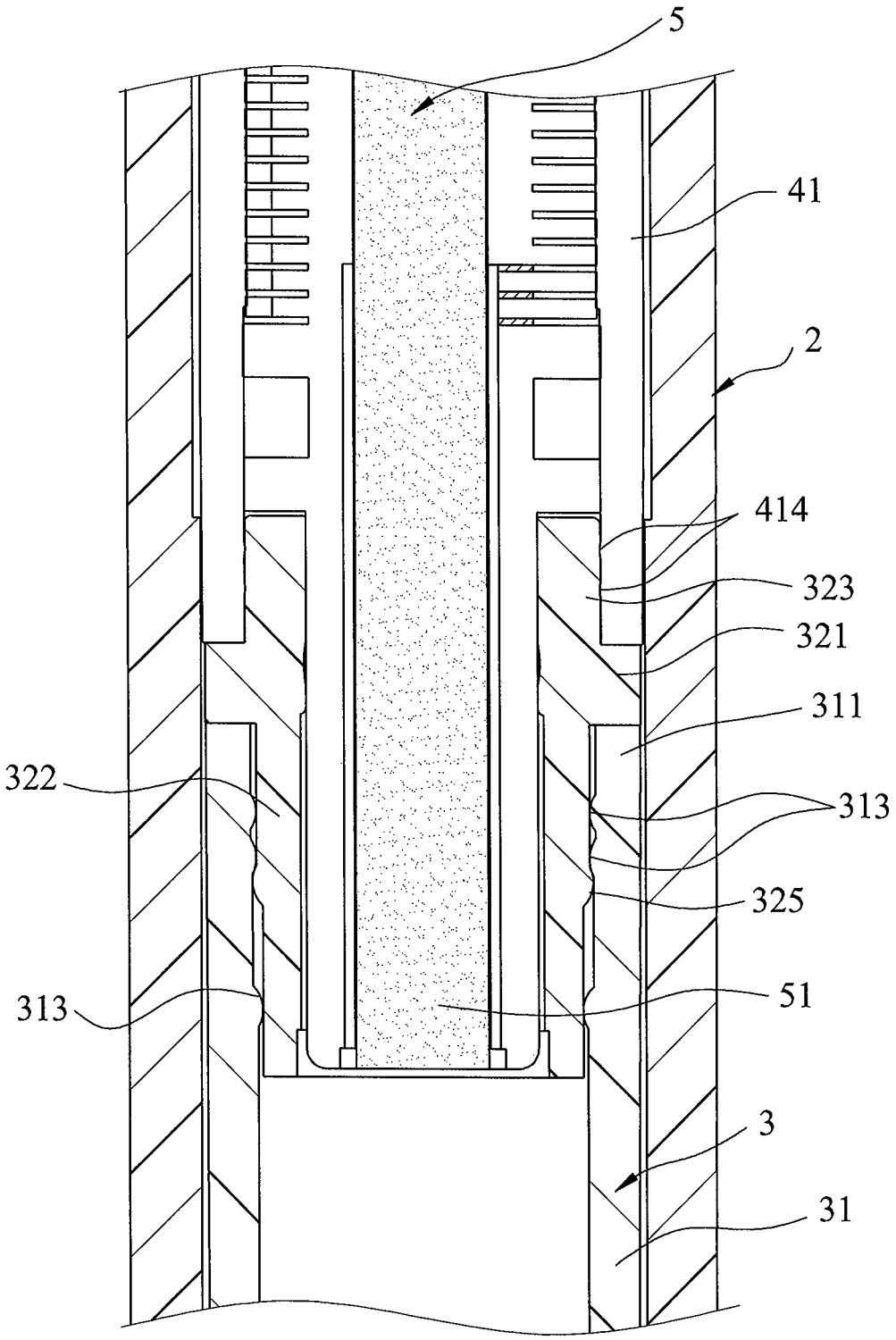
FIG. 4 is an enlarged fragmentary sectional view of the embodiment for illustrating the relationship among a cartridge, a plug member, an adjusting member and a sleeve of the embodiment.

With further reference to FIG. 4, the cartridge 3 is disposed in the casing 2, and includes a tube member 31 and a plug member 32. The tube member 31 is adapted for containing liquid cosmetic, and has an open end portion 311, a closed end portion 312 opposite to the open end portion 311, and a plurality of annular protrusions 313 formed on an inner surface of the open end portion 311. The plug member 32 is plugged into the open end portion 311 of the tube member 31, and has a shoulder section 321, a rear end section 322, a front end section 323, a positioning hole 324 and an annular protrusion 325. The shoulder section 321 abuts against an end of the open end section 311 of the tube member 31. The rear end section 322 extends from the shoulder section 321 into the open end portion 311, and has an outer surface. The front end section 323 is connected to the shoulder section 321 and is opposite to the rear end section 322. The positioning hole 324 extends through the rear end section 322, the shoulder section 321 and the front end section 323. The protrusion 325 is formed on the outer surface of the rear end section 322 and abuts airtightly against one of the protrusions 313 of the tube member 31. As such, a sealing effect between the outer surface of the rear end section 322 of the plug member 32 and the inner surface of the open end portion 311 of the tube member 31 is ensured. It is worth mentioning that, the number of protrusions 313 of the tube member 31 is not limited to what is disclosed herein; the tube member 31 may have only one protrusion 313 and still achieve the same effect.

The sleeve unit 4 includes a sleeve 41, a seat 42 and an adjusting member 43. The sleeve 41 is fixedly coupled to a front end of the casing 2, and has a rear end portion that is sleeved on the front end section 323 of the plug member 32, and that has a rear end abutting against the shoulder section 321 of the plug member 32. An outer surface of the sleeve 41 is connected fixedly to an inner surface of the casing 2, and an inner surface of the sleeve 41 defines a front hole 412 and a rear hole 413. The sleeve 41 further has two annular protrusions 414 that are formed in the inner surface at the rear end portion, and that abut airtightly against an outer surface of the front end section 323 of the plug member 32. It is worth mentioning that, the number of protrusions 414 of the sleeve 41 is not limited to what is disclosed herein; the sleeve 41 may have only one protrusion 414 and still achieve the same effect.

Figure 5:
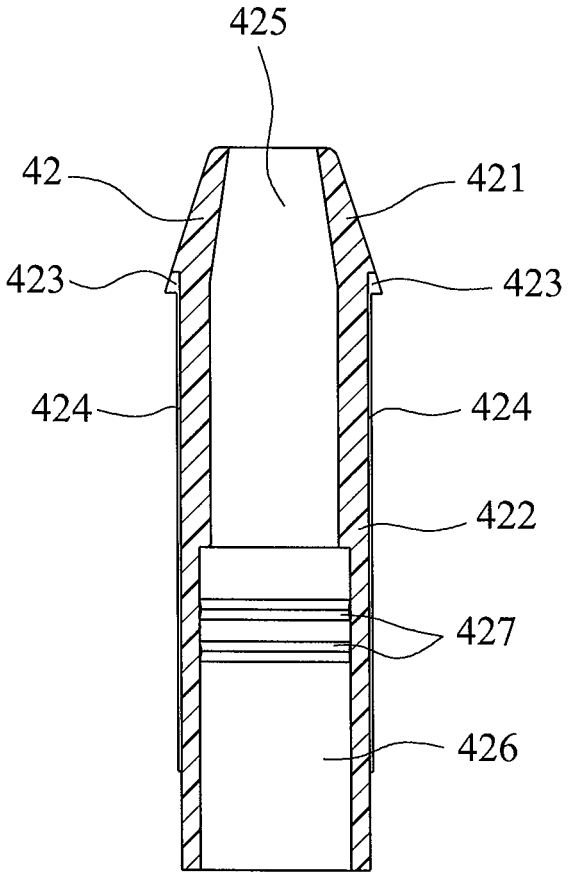
FIG. 5 is a sectional view of a seat of the embodiment.

Further referring to FIG. 5, in this embodiment, a front end of the sleeve 41 is sleeved onto the seat 42, and the seat 42 has a body portion 422, a head portion 421, a plurality of air inlets 423 and a plurality of air channels 424. The body portion 422 is disposed in the front hole 412 of the sleeve 41, and the head portion 421 extends from the body portion 422 and out of the sleeve 41. The air inlets 423 are formed in an outer surface of the head portion 421. Each of the air channels 424 is formed in an outer surface of the body portion 422, and is in spatial communication with a respective air inlet 423, such that air entering the air channels 424 through the air inlets 423 would flow into the rear hole 413 of the sleeve 41. In this embodiment, the seat 42 further has a tip hole 425 formed in the head portion 421, a receiving hole 426 formed in the body portion 422, and two annular protrusions 427 formed on an inner surface of the body portion 422 and disposed proximate to the tip hole 425.

Figure 6:
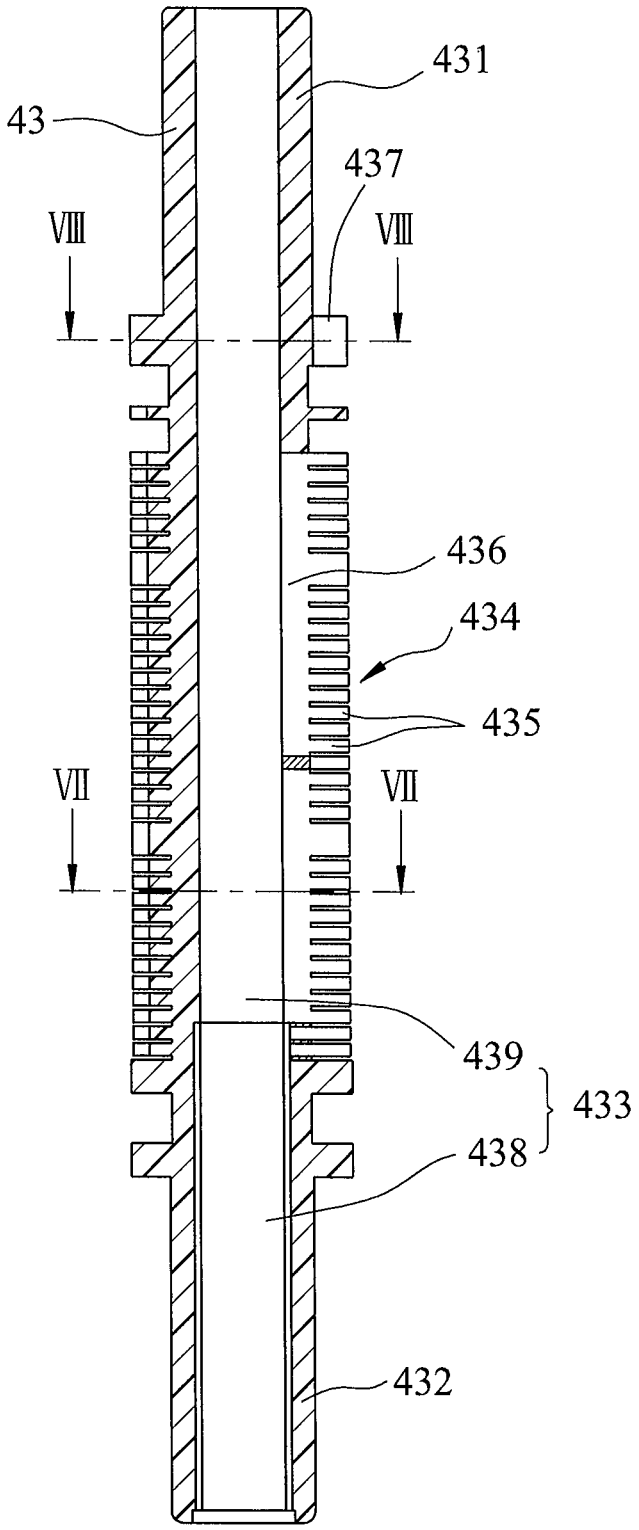
FIG. 6 is a sectional view of the adjusting member of the embodiment.

Further referring to FIG. 6, the adjusting member 43 is at least partially disposed in the sleeve 41, and has a first end section 431, a second end section 432, an axial hole 433 and an adjusting unit 434. The first end section 431 extends into the receiving hole 426 of the seat 42, and abuts airtightly against the protrusions 427 of the seat 42. The second end section 432 is opposite to the first end section 431 and extends through the positioning hole 324 of the plug member 32 and into the cartridge 3. The axial hole 433 extends through the first and second end sections 431, 432. The adjusting unit 434 is formed between the first and second end sections 431, 432, and is in fluid communication with the axial hole 433 and the air channels 424 of the seat 42.

Figure 7:
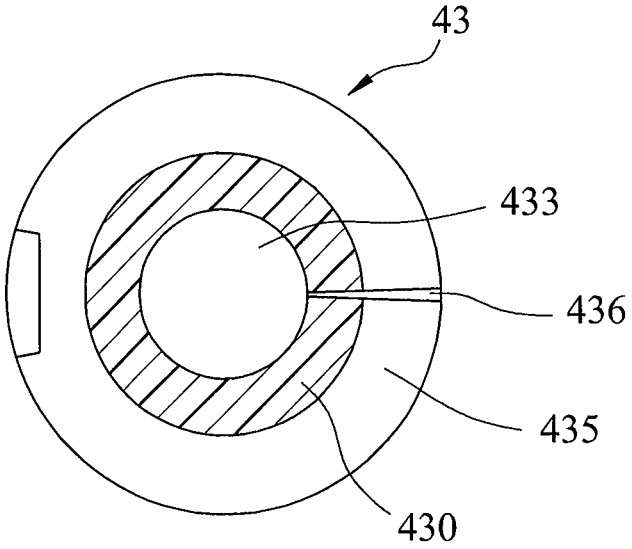
FIG. 7 is a sectional view of the embodiment, taken along line VII-VII of FIG. 6.
Figure 8:
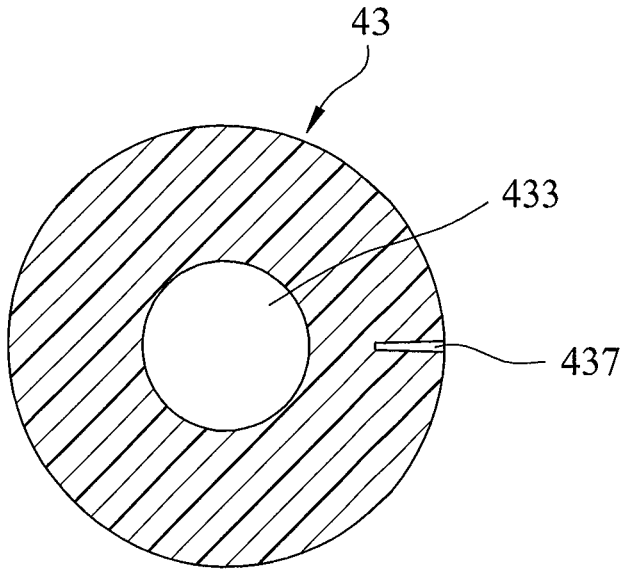
FIG. 8 is a sectional view of the embodiment, taken along line VIII-VIII of FIG. 6.

With further reference to FIG. 7, the adjusting member 43 further has a main body 430 disposed between the first and second end sections 431, 432, and formed with the adjusting unit 434. The adjusting unit 434 has a plurality of spaced-apart adjusting plates 435, a gap 436 and an opening 437 (see FIG. 8). The adjusting plates 435 are connected to the main body 430. The gap 436 is formed in the adjusting plates 435 and the main body 430, and communicates the axial hole 433 with the air channels 424. The opening 437 is formed in one of the adjusting plates 435 that is proximate to the first end section 431 of the adjusting member 43, and is in spatial communication with the air channels 424. The axial hole 433 has a venting portion 438 and an insert portion 439. The venting portion 438 is disposed in the second end section 432. The insert portion 439 has a rear end that is connected to the venting portion 438, and a front end that is connected to the positioning hole 324 of the plug member 32 of the cartridge 3, and that has a diameter smaller than that of the venting portion 438.

The core 5 extends through the axial hole 433 of the adjusting member 43 and the sleeve 41, and has an absorbing segment 51 and a liquid output segment 52. The absorbing segment 51 extends through the sleeve 41 and the positioning hole 324 of the plug member 32 for absorbing the liquid cosmetic in the cartridge 3. The liquid output segment 52 extends out of the sleeve 41 and the seat 42. The absorbing segment 51 and the liquid output segment 52 are integrally formed as one piece in this embodiment.

Figure 9:
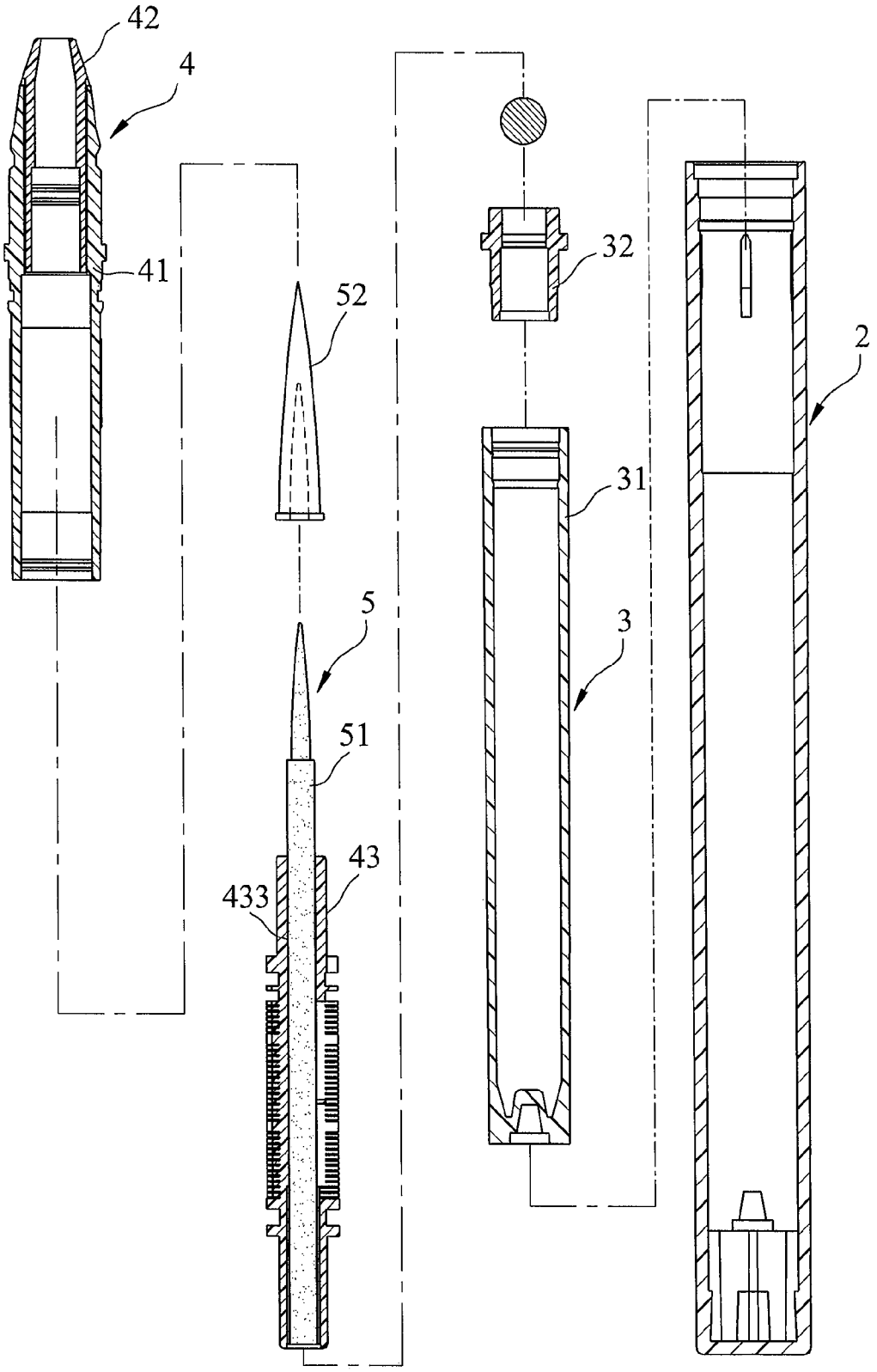
FIG. 9 is an exploded sectional view of a variation of the embodiment, in which the cap is omitted.
Figure 10:
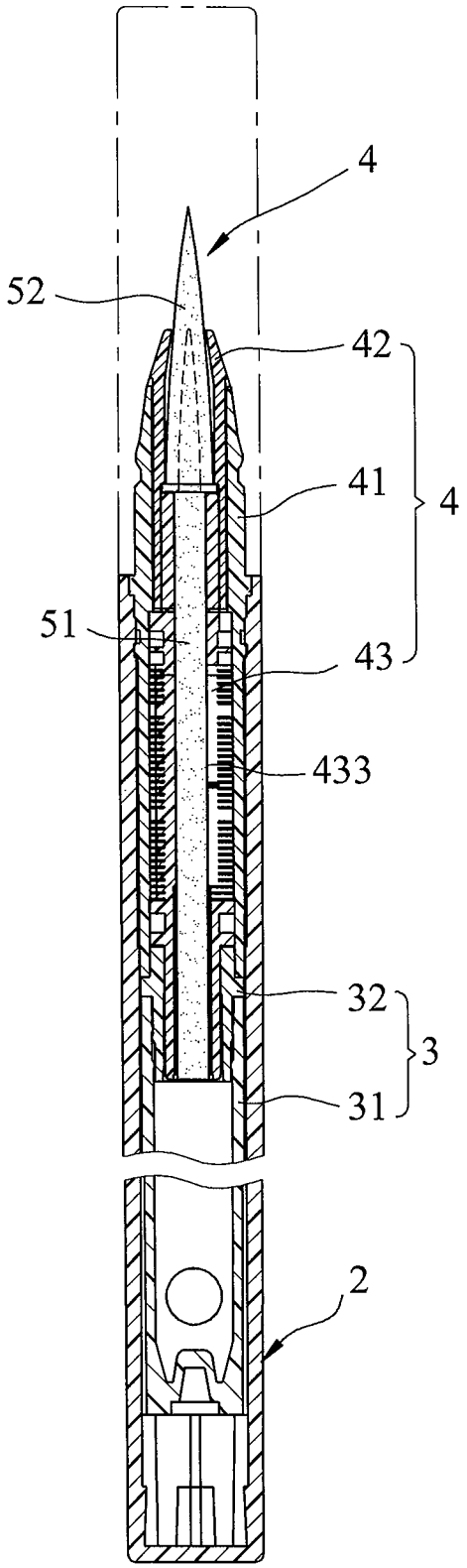
FIG. 10 is a fragmentary sectional view of the variation of the embodiment.

It is worth mentioning that, with reference to FIGS. 9 and 10, the configuration of the core 5 may vary in a manner that the absorbing segment 51 of the core 5 is made of cotton, and the liquid output segment 52 is configured as a bristle and is coupled to the absorbing segment 51.

The cap 6 is coupled removably to the sleeve 41 for enclosing the liquid output segment 52 of the core 5 therebetween.

The foregoing describes the structure of the cosmetic applicator of the present invention. The process of achieving the purpose of this invention is described as follows.

Figure 11:
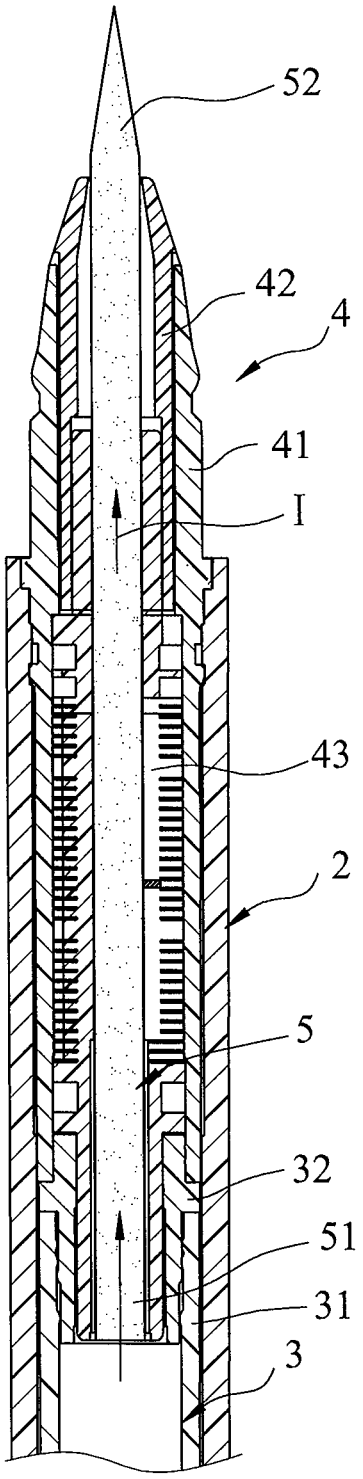
FIG. 11 is an enlarged fragmentary sectional view for illustrating a liquid passage of the embodiment.

Referring to FIG. 11, the tube member 31 of the cartridge 3 and the core 5 cooperatively define a liquid passage (I). When the cosmetic applicator is in use, the liquid cosmetic inside the cartridge 3 is absorbed by the absorbing segment 51 of the core 5, and flows through the liquid passage (I) toward the liquid output segment 52 of the core 5 and out of the cosmetic applicator.

Figure 12:
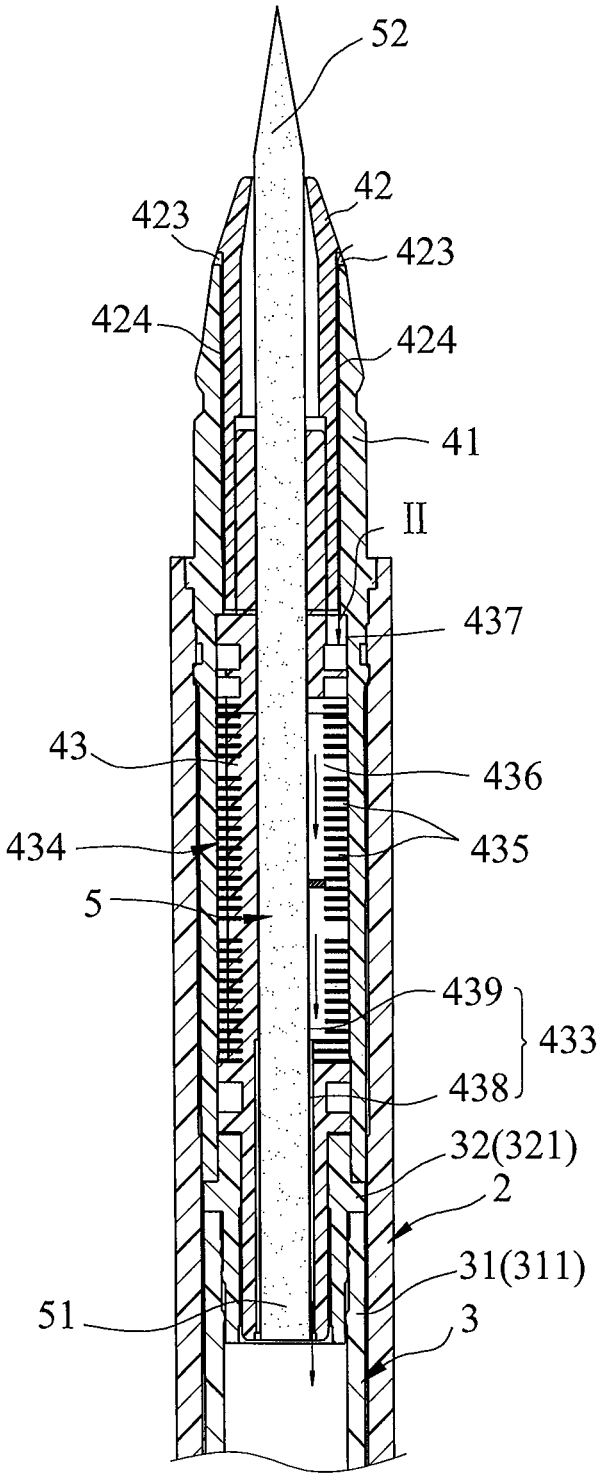
FIG. 12 is an enlarged fragmentary sectional view for illustrating an air passage of the embodiment.

Referring to FIG. 12, the air inlets 423, the air channels 424, the adjusting unit 434, the axial hole 433 (the venting and insert portions 438, 439) and the tube member 31 of the cartridge 3 cooperatively define an air passage (II). When the liquid cosmetic exits the cosmetic applicator via the liquid passage (I) (see FIG. 11), the amount of liquid cosmetic in the cartridge 3 is reduced, thus creating negative pressure. At this time, air enters the seat 42 through the air inlets 423, passes through the air passage (II) and into the cartridge 3 for canceling the negative pressure to balance the pressure inside the cartridge 3 such that the liquid cosmetic can be applied smoothly and consistently.

In sum, by the provision of the protrusions 313, 325, which create an airtight seal between the tube member 31 and the plug member 32, the liquid cosmetic will not leak into the internal space among the casing 2, the cartridge 3 and the sleeve unit 4, which would otherwise result in waste. In addition, by virtue of the provision of the adjusting member 43 extending in the sleeve 41 between the seat 42 and the plug member 32, and the protrusions 414, 427 of the sleeve 41 and the seat 42, the liquid cosmetic stored between the adjusting plates 435 of the adjusting member 43 will not leak through a gap between the sleeve 41 and the casing 2.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A cosmetic applicator comprising:

a casing;

a cartridge disposed in said casing, and including a tube member that is adapted for containing liquid cosmetic, and that has an open end portion and at least one protrusion formed on an inner surface of said open end portion, and a plug member that has a shoulder section abutting against an end of said open end portion, a rear end section that extends from said shoulder section into said tube member, and that has an outer surface abutting airtightly against said at least one protrusion, a front end section that is connected to said shoulder section and that is opposite to said rear end section, and a positioning hole that extends through said rear end section, said shoulder section and said front end section;

a sleeve fixedly coupled to a front end of said casing, and having a rear end portion that is sleeved on said front end section of said plug member, and that has a rear end abutting against said shoulder section of said plug member, and at least one protrusion that is formed in an inner surface of said rear end portion and that abuts airtightly against an outer surface of said front end section of said plug member; and a core having an absorbing segment that extends through said sleeve and said positioning hole of said plug member for absorbing the liquid cosmetic, and a liquid output segment that extends out of said sleeve.

2. The cosmetic applicator as claimed in claim 1, further comprising a cap coupled removably to said sleeve for enclosing said liquid output segment of said core therebetween.

3. The cosmetic applicator as claimed in claim 1, wherein said tube member has at least two of said protrusions abutting airtightly against said outer surface of said rear end section of said plug member, and said plug member further has a protrusion formed on said outer surface of said rear end section and abutting airtightly against one of said protrusions of said tube member.

4. The cosmetic applicator as claimed in claim 1, wherein said absorbing segment and said liquid output segment of said core are integrally formed as one-piece.

5. The cosmetic applicator as claimed in claim 1, further comprising:

a seat having a body portion that is disposed in said sleeve, a head portion that extends from said body portion and out of said sleeve, at least one air inlet that is formed in an outer surface of said head portion; and at least one air channel that is formed in an outer surface of said body portion, and that is in spatial communication with said at least one air inlet; and an adjusting member at least partially disposed in said sleeve and having a first end section that extends into said seat, a second end section that is opposite to said first end section and that extends into said positioning hole of said plug member, an axial hole that extends through said first and second end sections, said core extending through said axial hole, said liquid output segment extending out of said seat, and an adjusting unit that is formed between said first and second end sections and that is in fluid communication with said axial hole and said at least one air channel of said seat;

wherein said tube member of said cartridge and said core cooperatively define a liquid passage, said at least one air inlet, said at least one air channel, said adjusting unit, said axial hole and said tube member of said cartridge cooperatively defining an air passage, air being introduced into said cartridge through said air passage when the liquid cosmetic flows out of said cartridge through said liquid passage, thereby balancing the pressure inside said cartridge and ensuring a smooth application of the liquid cosmetic.

6. The cosmetic applicator as claimed in claim 5, wherein said absorbing segment of said core is made of cotton, and said liquid output segment of said core is configured as a bristle.

7. The cosmetic applicator as claimed in claim 5, wherein:

said adjusting member further has a main body disposed between said first and second end sections and formed with said adjusting unit; and said adjusting unit of said adjusting member has a plurality of spaced-apart adjusting plates connected to said main body, a gap formed in said adjusting plates and said main body, and communicating said axial hole with said at least one air channel, and an opening formed in one of said adjusting plates that is proximate to said first end section of said adjusting member, and being in spatial communication with said air channel.

8. The cosmetic applicator as claimed in claim 5, wherein said seat further has a receiving hole formed in said body portion for receiving said first end section of said adjusting member, and at least one protrusion formed on an inner surface of said body portion, and abutting against an outer surface of said first end section.

9. The cosmetic applicator as claimed in claim 5, wherein said axial hole of said adjusting member has a venting portion disposed in said second end section, and an insert portion having a rear end that is connected to said venting portion, and a front end that is connected to said positioning hole of said plug member of said cartridge, and having a diameter smaller than that of said venting portion.

* * * * *